US011365939B2

(12) United States Patent
Dieumegard

(10) Patent No.: US 11,365,939 B2
(45) Date of Patent: Jun. 21, 2022

(54) SEALED CONNECTION OF A CONNECTOR TO A COAXIAL TUBULAR HEAT EXCHANGER

(71) Applicant: HUTCHINSON, Paris (FR)

(72) Inventor: Bérenger Dieumegard, Fleury les Aubrais (FR)

(73) Assignee: HUTCHINSON, Paris (FR)

( * ) Notice: Subject to any disclaimer, the term of this patent is extended or adjusted under 35 U.S.C. 154(b) by 0 days.

(21) Appl. No.: 17/144,961

(22) Filed: Jan. 8, 2021

(65) Prior Publication Data

US 2021/0215429 A1 Jul. 15, 2021

(30) Foreign Application Priority Data

Jan. 9, 2020 (FR) ..... 2000143

(51) Int. Cl.
*F28D 7/10* (2006.01)
*F28F 9/02* (2006.01)

(52) U.S. Cl.
CPC ..... *F28D 7/106* (2013.01); *F28F 9/0248* (2013.01); *F28F 9/0256* (2013.01); *F28F 2275/025* (2013.01); *F28F 2275/04* (2013.01); *F28F 2275/06* (2013.01)

(58) Field of Classification Search
CPC ..... F28D 7/106; F28F 9/0248; F28F 9/0256; F28F 2275/025; F28F 2275/04; F28F 2275/06; F28F 21/084
See application file for complete search history.

(56) References Cited

U.S. PATENT DOCUMENTS 6,550,815 B2 * 4/2003 Zitkowic, Jr. ..... F16L 37/144 285/305
10,473,252 B2 * 11/2019 Oberdorfer ..... F16L 53/32
10,508,867 B2 * 12/2019 Dowell, Jr. ..... F28D 7/106
2009/0260586 A1 10/2009 Geskes et al.
(Continued)

FOREIGN PATENT DOCUMENTS

EP 0276521 A1 8/1988
EP 1128120 A2 8/2001
EP 1762806 A1 3/2007
(Continued)

OTHER PUBLICATIONS

Rapport De Recherche Preliminaire dated Sep. 25, 2020, received in corresponding French application No. 2000143, filed Jan. 9, 2020, 2 pages.

*Primary Examiner* — Jon T. Schermerhorn, Jr.
(74) *Attorney, Agent, or Firm* — Christensen O'Connor Johnson Kindness PLLC

(57) ABSTRACT

A method provides a sealed connection of a connector to a heat exchanger of the coaxial tubular type is particularly suitable for a motor vehicle air-conditioning circuit. The method includes the steps of mounting a free end of an external tube of the exchanger in or on the connector. The external tube is directly secured with the connector, and an internal tube is inserted in the external tube until a free end of the internal tube is mounted in or on the connector. This mounting ensuring a sealing between the internal tube and the connector. The method further includes directly securing the internal and external tubes against one another to avoid relative displacements.

12 Claims, 8 Drawing Sheets

(56) References Cited

U.S. PATENT DOCUMENTS

| | | | | |
|---|---|---|---|---|
| 2011/0214847 | A1* | 9/2011 | Hur | F28D 7/106<br>165/143 |
| 2011/0241333 | A1* | 10/2011 | Borgmeier | F16L 53/32<br>285/132.1 |

FOREIGN PATENT DOCUMENTS

| | | | |
|---|---|---|---|
| EP | 2199721 | A1 | 6/2010 |
| GB | 2085574 | A | 4/1982 |
| WO | 2007013439 | A1 | 2/2007 |
| WO | 2011057594 | A1 | 5/2011 |
| WO | 2019050258 | A1 | 3/2019 |

* cited by examiner

[Fig.1]
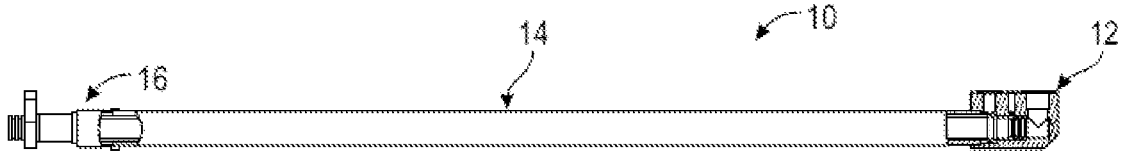

[Fig.2]
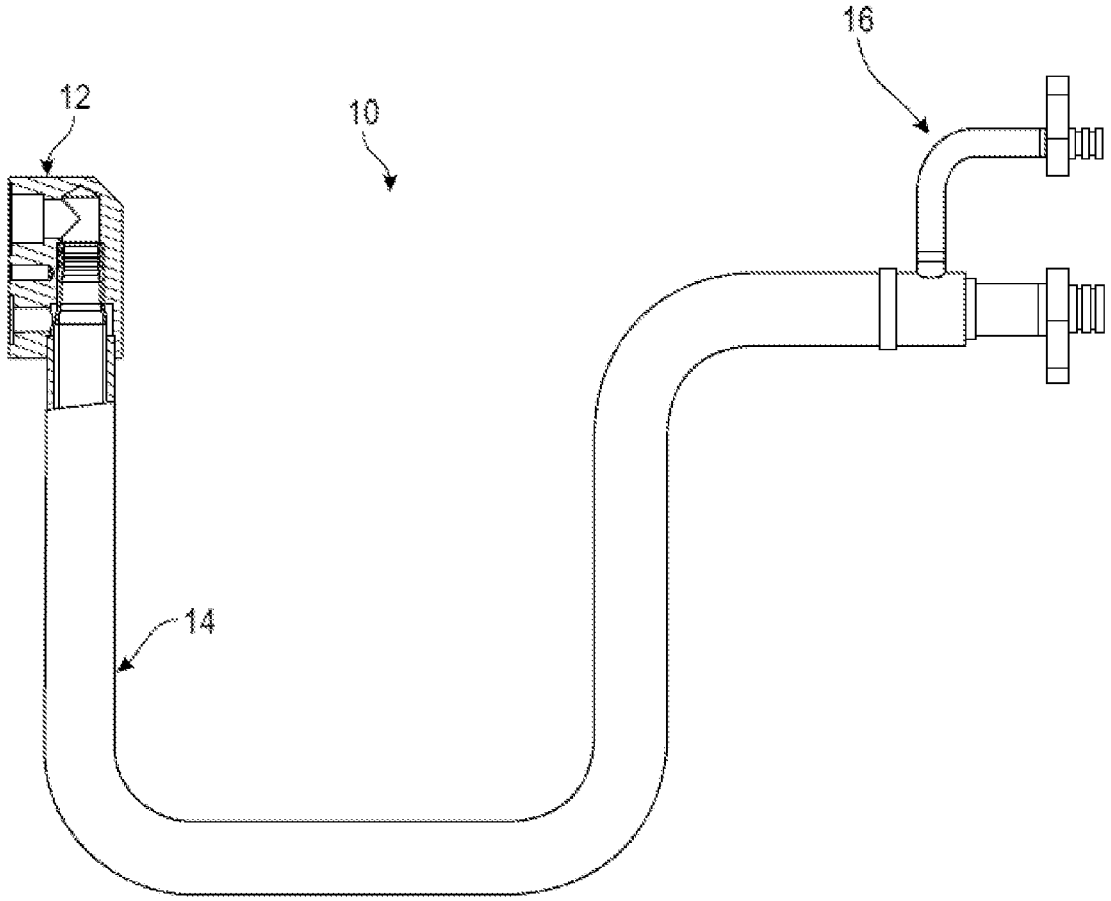

[Fig.3]
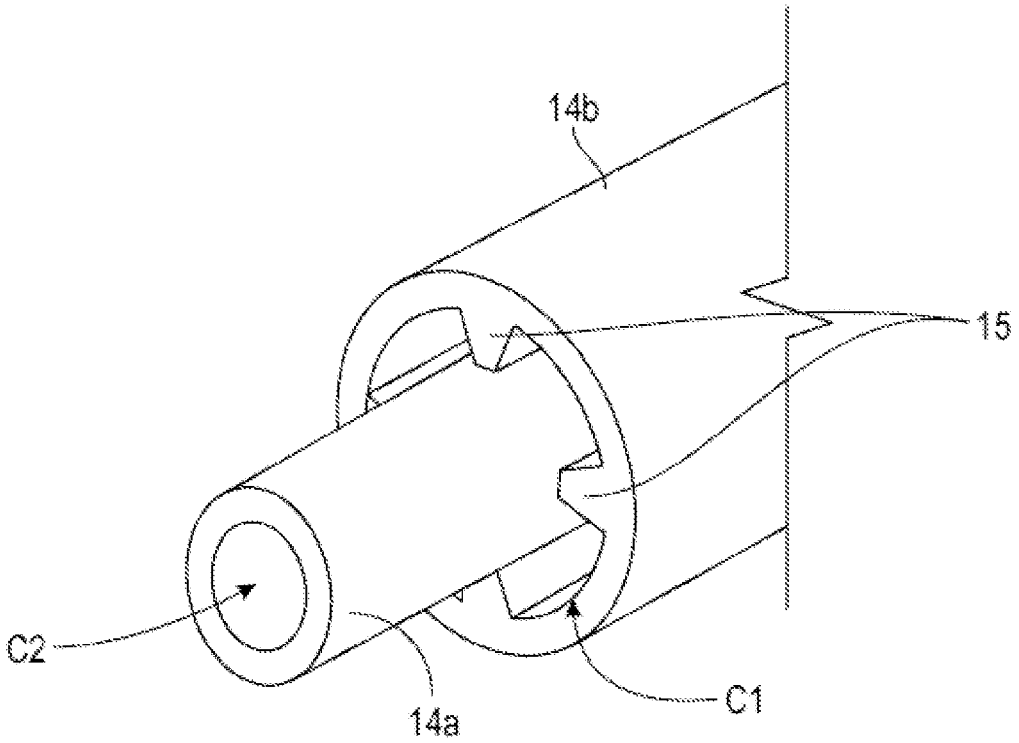

[Fig.4]
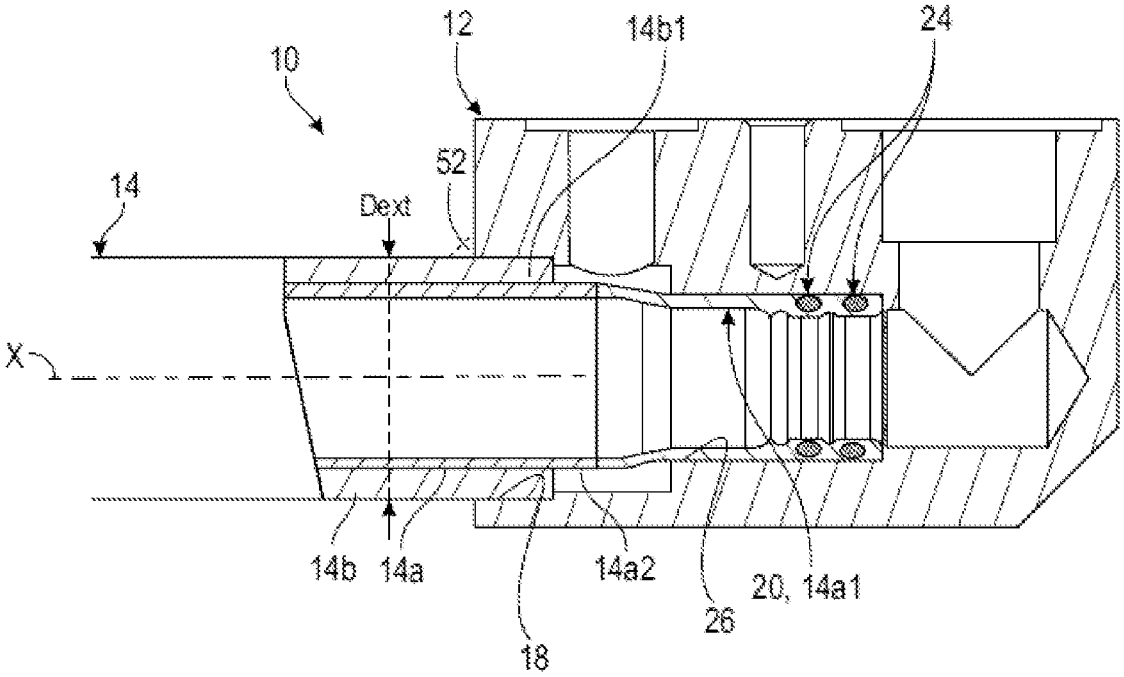

[Fig.5]
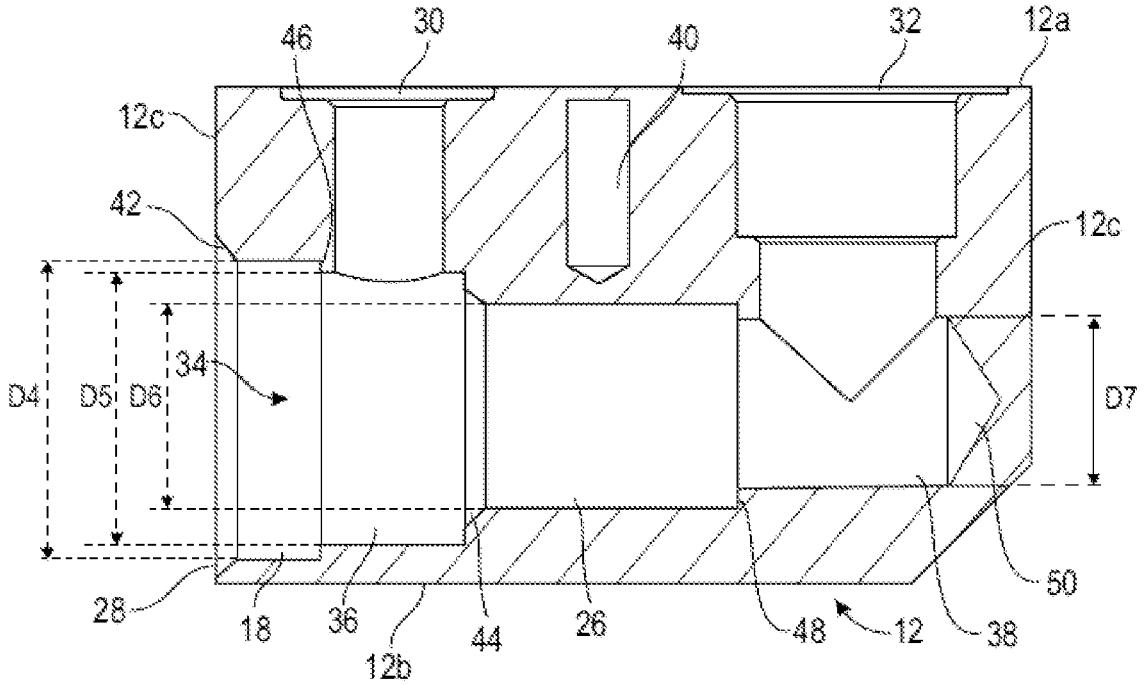

[Fig.6]
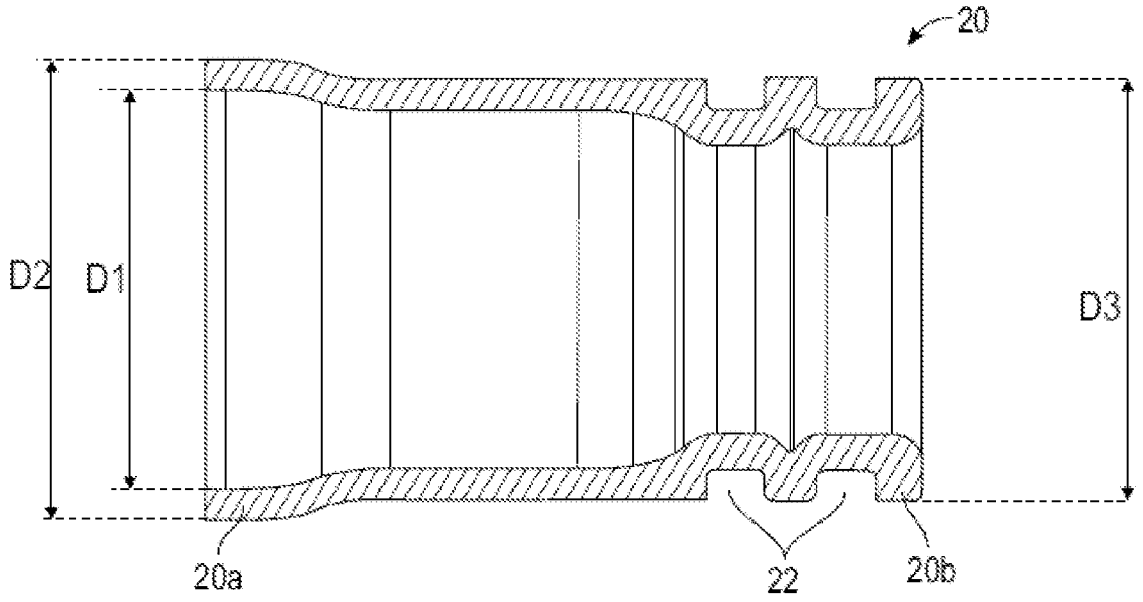

[Fig.7]
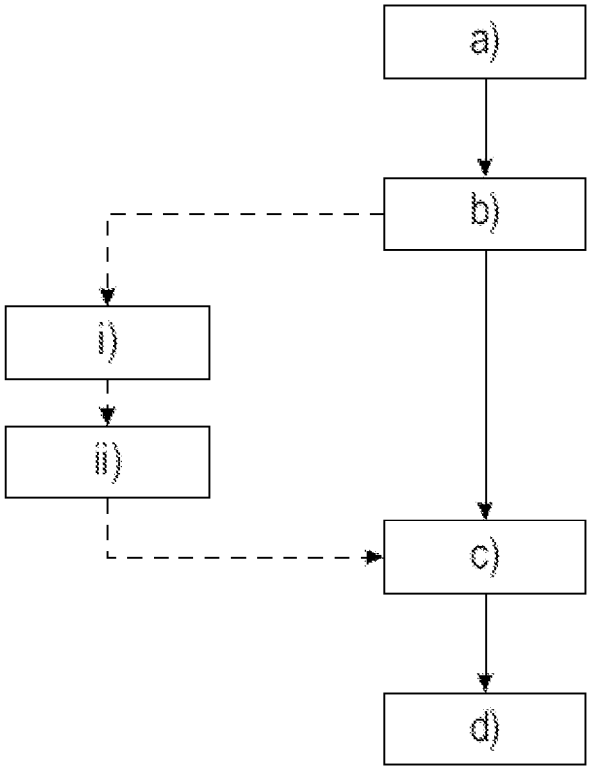

[Fig.8]
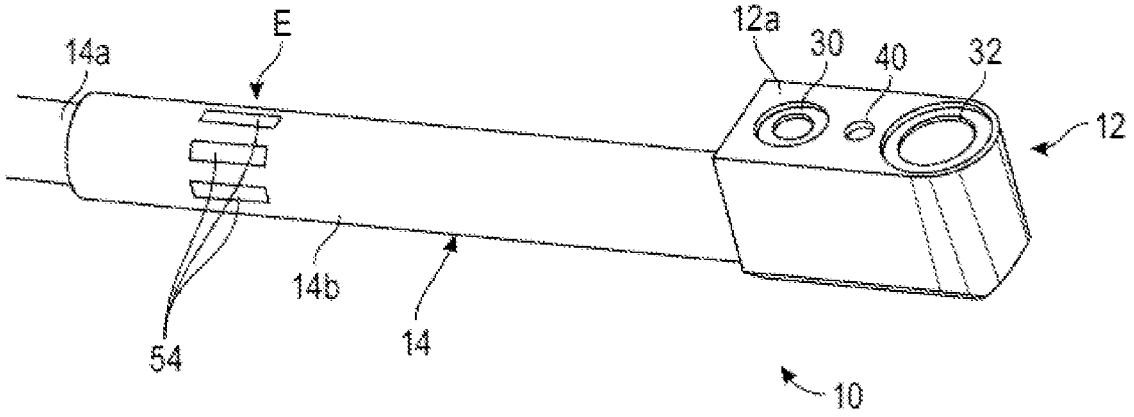

SEALED CONNECTION OF A CONNECTOR TO A COAXIAL TUBULAR HEAT EXCHANGER

CROSS-REFERENCE TO RELATED APPLICATION

This application claims priority under 35 U.S.C. § 119 to French Patent Application No. 2000143, filed Jan. 9, 2020, which is incorporated by reference herein in its entirety.

FIELD

The present disclosure is directed to a method for creating a sealed connection of a connector to a coaxial tubular-type heat exchanger, as well as a fluidic connection device, in particular for an air-conditioning circuit of a vehicle.

BACKGROUND

In certain air-conditioning circuit for automotive vehicles, in particular those using carbon dioxide or R134a as refrigerating fluid, it is necessary to achieve a heat exchange or transfer between the fluid of the high-pressure portion of the circuit that is sought to cool and the same fluid coming from the low-pressure portion of this circuit which serves as a cold source and which is heated in exchange, to improve the efficiency of the circuit. To this end, a so-called "internal" heat exchanger is used, due to any exchange with the outside air of the vehicle, nor with the air of the cabin not being sought.

Generally, a heat exchanger is metallic and is connected to the corresponding pipes of the air-conditioning circuit which comprise, in particular, hoses, via connectors mounted to each of the ends of the exchanger which can be, for example, of the plate type, being constituted of a stack of flat tubes and achieving the heat exchange, both by convection with the outside air to the exchanger, and by conduction, or multi-tube type which in its simplest version, is of the counter-current coaxial tubular type, thus achieving the heat exchange without the abovementioned convection.

In the latter case, this coaxial exchanger defines generally at least one radially internal channel, delimited by a sleeve and intended to convey the fluid coming from the high-pressure portion of the circuit, and at least one radially external channel comprised between the sleeve and the casing of the exchanger and intended to convey the fluid coming from the low-pressure portion of the circuit. The sleeve and the casing are formed of one single part and connected together by longitudinal fins distributed on the circumference of the exchanger.

It is known to use two female connectors for the end concerned of such a coaxial exchanger, that is welded or brazed axially, both separated on the sleeve and on the sleeve via three welding or brazing lines, such that these connectors define respectively passage conduits for the fluid communicating in a sealed manner with these internal and external channels. For example, document WO-A1-2007/1013439 can be mentioned for the description of these connectors.

A major disadvantage of these coaxial internal exchangers equipped with female connectors resides in the mutual proximity of the welding or brazing lines generated which, in particular for successive brazing, generate refusion risks of the prior brazing, and also in the necessity of carrying out this welding or brazing in a blind manner, with risks of non-sealing to the junction and/or penetration of the brazing in the corresponding internal or external channel, which could, due to this, lead to load losses, a pollution even a blocking of these channels.

It is also known to use one single connector at the connecting end of a coaxial exchanger, as for example described in document EP-A1-1 762 806 where the connector is assembled to the external casing and to the internal sleeve by brazing via an intermediate connector, and in document EP-A1-1 128 120 (FIG. 10 et seq.) where the connector is brazed directly on the casing and on the sleeve of the exchanger via two brazing seams.

A major disadvantage of the coaxial internal exchangers presented in these two latter documents is that their assembly to a connector requires at least two brazing operations to be carried out at the same time and of which at least one, relative to the junction to be performed between the connector and the internal sleeve, is necessarily "in a blind manner" or under difficult conditions due to its location inside the connector. This results in significant risks of non-compliance with connector and therefore loss of fluid transferred. In addition, this brazing involves a production cost and a relatively high rejection rate for the connection obtained.

The Applicant proposed a solution in document EP-A1-2 199 721. This solution consists of assembling the connector to the casing by welding, and to the sleeve by at least one annular sealing lining which is mounted on an axial extension of the sleeve with respect to the casing. The axial distance between the lining and the welding line is sufficiently important, such that this lining is not altered by the welding. The exchanger being formed of one single part, the sleeve and the casing are inseparable and are therefore mounted simultaneously in the connector.

Although this solution is effective, it is not fully satisfactory, as the axial extension of the sleeve leads to an important bulk of the exchanger and of the connector.

The disclosed subject matter provides an alternative to this solution.

SUMMARY

The present disclosure provides a method of sealed connection of a connector to a coaxial tubular-type heat exchanger, in particular for a motor vehicle air-conditioning circuit, this exchanger comprising two coaxial tubes, respectively internal and external, the external tube defining around the internal tube, a first annular channel for the circulation of a first fluid, and the internal tube defining a second internal channel for the circulation of a second fluid, the tubes being independent from one another and one of the tubes comprising projections in abutment on the other of the tubes to keep the tubes at a distance from one another, the connector comprising two passage cavities of the fluids communicating respectively with the channels of the exchanger, characterized in that the process comprises the following successive steps:

a) a free end of the external tube is mounted in or on the connector, b) the external tube is directly secured with the connector, c) the internal tube is inserted in the external tube until a free end of the internal tube is mounted in or on the connector, this mounting ensuring a sealing between the internal tube and the connector, and d) the internal and external tubes are directly secured against one another to avoid relative displacements.

Contrary to the disclosure of document EP-A1-2 199 721, the internal and external tubes of the exchanger are independent. They are thus mounted after one another in or on the connector. In particular, the external tube is mounted in step a) and secured to the connector in step b). This securing can be achieved by welding or brazing if the external tube and the connector are metallic. In a variant, in the case where the external tube and the connector would be made of other materials, their securing could be ensured by gluing, electron beam welding, etc. During this securing step b), the internal tube is not yet inserted in the external tube and therefore does not risk being altered by the securing operation, and for example, by the heating induced by a securing by welding. Then, in step c), the internal tube is inserted in the external tube, until the internal tube engages in a sealing manner with the connector. This is generally a mounting in a blind manner There is, strictly speaking, no securing of the internal tube directly to the connector. They are simply engaged in one another or on top of one another. The internal tube is indirectly secured with respect to the connector, by way of the external tube. This securing of the tubes is achieved in step d) and makes it possible to prevent any relative movement between the tubes in operation.

The method according to the present disclosure can comprise one or more of the following steps or features, taken individually from one another or in combination with one another:

- step d) is carried out by plastic deformation of at least one of the tube, and in particular by crimping the external tube on the internal tube, or by simultaneous bending of the internal and external tubes;
- the method comprises, between steps b) and c), a step of mounting at least one annular seal around the free end of the internal tube;
- during steps a) and c), the tubes are engaged by male-female interlocking respectively in two housings of the connector;
- during steps a) and c), the tubes are guided at the inlet of the housing by engagement of their free ends with the chamfers of the connector;
- before step c), the free end of the internal tube is plastically deformed or comprises a plastically deformed member, to achieve at least one annular recess at its external periphery, and preferably two annular recesses adjacent to its external periphery;
- before step c), the free end of the internal tube is plastically deformed or comprises a plastically deformed member, to modify its external diameter, at at least one end;
- the internal and external tubes are made of metallic material;
- the internal and external tubes are made of different materials;
- the internal tube is metallic and the external tube is made of plastic or composite material;
- the securing of the external tube to the connector is achieved by welding, brazing or gluing;
- the connector is metallic.

The present disclosure also concerns a fluidic connection device comprising a connector and a coaxial tubular-type heat exchanger, in particular for a motor vehicle air-conditioning circuit, the connector forming two cavities for the passage of fluids communicating respectively with channels of the exchanger, the exchanger comprising two coaxial tubes, respectively internal and external, the external tube defining around the internal tube, a first annular channel for the circulation of a first fluid, and the internal tube defining a second internal channel for the circulation of a second fluid, the tubes being independent and one of the tubes comprising projections in abutment on the other of the tubes to keep the tubes at a distance from one another, characterized in that it is obtained by a method such as described above and in that:

the external tube comprises a free end which is engaged in or on the connector, this external tube being directly secured to the connector, and the internal tube comprises a free end which is mounted in or on the connector, this mounting ensuring a sealing between the internal tube and the connector, the internal and external tubes being directly secured against one another to avoid relative displacements.

Advantageously, the securing of the internal and external tubes is obtained thanks to a crimping of the external tube on the internal tube, to the simultaneous bending of the internal and external tubes, or to the welding of the ends of the internal and external tubes opposite the connector.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein:

FIG. 1 is a schematic, perspective view of a fluidic connection device according to the present disclosure, comprising in particular a heat exchanger and a connector, this device being in a first position preceding a shaping operation, FIG. 2 is a schematic, perspective view of the device of FIG. 1, this device being in a second position following a shaping operation, FIG. 3 is a schematic, perspective view of a coaxial tubular heat exchanger, FIG. 4 is a schematic view on a larger scale of a detail of the device of FIGS. 1 and 2, the connector and a portion of the exchanger being represented in an axial cross-section, FIG. 5 is a schematic, axial cross-sectional view of the connector of the device of FIGS. 1 to 3, FIG. 6 is a schematic, axial, cross-sectional view of a free end of an internal tube of the exchanger of the device of FIGS. 1 to 3, FIG. 7 is a flowchart showing the steps of a method according to the present disclosure of sealed connection of a connector to an exchanger, and FIG. 8 is a schematic, partial, perspective view of an embodiment variant of the device according to the present disclosure.

DETAILED DESCRIPTION

FIGS. 1 to 6 illustrate an embodiment of a fluidic connection device 10 according to the present disclosure, for an air-conditioning circuit of a vehicle, in particular automotive.

The device 10 which can be seen in its entirety in FIGS. 1 and 2 comprises, in the example represented, a connector 12, here female, and a coaxial tubular-type heat exchanger 14.

The exchanger 14 has a general extended shape and comprises two coaxial tubes extending inside one another. The internal tube is referenced 14*a* and the external tube is referenced 14*b*.

The external tube 14*b* defines around the internal tube 14*a*, an annular channel C1 for the circulation of a first fluid, and the internal tube 14*a* defines a second internal channel C2 for the circulation of a second fluid (FIG. 3). To guarantee a sufficient space between the tubes and the formation of the channel C1, one of the tubes generally comprises projections, such as fins, in abutment on the other of the tubes to keep them at a distance from one another. The fins can extend parallel to the longitudinal axis X of the exchanger 14 or helicoidally around this axis. They can be continuous or discontinuous.

It is thus understood that the external tube 14*b* can comprise, on its internal cylindrical surface surrounding the internal tube 14*a*, internal fins 15 which bear on an external cylindrical surface of the internal tube 14*a* (FIG. 3). In a variant, the internal tube 14*a* can comprise on its external cylindrical surface surrounded by the external tube 14*b* of the external fins which bear on an internal cylindrical surface of the external tube 14*b*.

The tubes 14*a*, 14*b* can be made of identical or different materials. They can be made of metal alloy(s) or of plastic material(s), for example The connector 12 is located at a longitudinal end of the exchanger 14, of which the opposite longitudinal end is connected to another type of connector 16, which does not form part of the present disclosure.

In FIG. 1, the exchanger 14 has a straight shape. In FIG. 2, the exchanger 14 has a shape presenting several bends. The exchanger 14 of FIG. 2 has undergone a forming, shaping or bending step, from the initial shape of FIG. 1. As will be explained below, this shaping can make it possible to secure the tubes 14*a*, 14*b* together, in particular in the zones where the tubes are bent simultaneously and plastically deformed by being clamped against one another. The device 10 of FIG. 2 is ready to be mounted in an air-conditioning circuit and to be used.

FIG. 4 is a larger scale view of the connector 12 and of its connection to an end of the exchanger 14. The connector 12 is represented by itself in FIG. 5.

As can be seen in FIG. 4, the external tube 14*b* has a straight disconnected end (in a plane perpendicular to the longitudinal axis X of the exchanger 14) forming a free end 14*b*1, this free end 14*b*1 being engaged in a housing 18 of the connector 12.

The internal tube 14*a* has a free end 14*a*1 which is preferably formed of one single part with the remainder of the tube, but which can be, in a variant, formed by reporting and fixing a tubular member 20 on an end 14*a*2 of the tube 14*a*.

This free end 14*a*1 or this member 20 is represented by itself in FIG. 6. The end 14*a* or the member 20 has undergone a forming or shaping operation. Before this operation, it comprises internal and external cylindrical surfaces and constant internal and external diameters. After this operation, and as illustrated, it has a flared portion 20*a* for connecting to the remainder of the internal tube 14*a*. In the case of using a reported member 20, the end-to-end connection of the member 20 to the end 14*b*1 of the tube 14*a*, as illustrated in FIG. 4, can be achieved by welding or brazing, for example. This portion 20*a* has internal D1 and external D2 diameters substantially identical to those of the internal tube 14*a*.

The remainder of the end 14*a*1 or of the member 20 presents an external cylindrical surface 20*c* of which the external diameter D3 is less than D2, and here greater than D1. At its end 20*b* opposite the portion 20*a*, the end 14*a*1 or the member 20 comprises at least one external annular recess 22 for receiving an annular seal 24.

In the example represented, the end 14*a*1 or the member 20 comprises two adjacent recesses 22 and therefore carries two seals 24 (FIG. 4).

The seals 24 are preferably made of elastomer. In a variant, they could be made of metal.

The end 14*a*1 or the member 20 is intended to be engaged in a housing 26 of the connector 12 and the seals 24 are intended to engage with a surface, here cylindrical, of this housing 26.

Now, FIG. 5 is referred to, which illustrates the connector 12.

The connector 12 presents itself in the form of a material block, for example metallic or plastic.

The connector 12 has a general parallelepiped shape and comprises an upper face 12*a*, a lower face 12*b*, and side faces 12*c*.

The connector 12 comprises three ports 28, 30 and 32. The port 28 is located on one of the faces 12*c* and opens out into a bore 34 comprising the housings 18 and 26.

The ports 30, 32 are substantially parallel to one another and perpendicular to the port 28 and to the axis of the bore 34 which is intended to be combined with the axis X of the exchanger 14.

The ports 30 and 32 are located on the upper surface 12*a* and are at a distance from one another. They form, for example, female elements configured to co-operate with male elements of a pipe or of a connector in view of the fluidic communication between this pipe or connector and the connector 12. The port 30 is located on the side of the port 28 and opens out into a cavity 36 of the bore 34, and the port 32 is located on the side opposite the port 28 and opens out into another cavity 38 of the bore 34.

Moreover, between the ports 30, 32, the face 12*a* of the connector 12 comprises a tapped orifice 40 for receiving a fixing screw of the connector 12 to an element or to another fluidic connector of the vehicle.

In the example represented, the bore 34 is staged and therefore comprises several successive stages of different diameters and formed in particular by the housings 18, 26 and the cavities 36, 38.

The bore 24 first comprises the housing 18 which is connected to the port 28 and to the face 12*c* by a first chamfer 42. This housing 18 has an external diameter D4.

The bore 24 then comprises the cavity 36 which extends between the housing 18 and a chamfer 44 for connecting to the other housing 26. The cavity 36 has an external diameter D5 and the housing 26 has an external diameter D6, D5 being comprised between D4 and D6.

The housing 18 is connected to the cavity 36 by a cylindrical seat 46.

The bore 34 finally comprises the cavity 38 which is connected to the housing 26 by another cylindrical seat 48 and which is ended by a blind hole 50 in the vicinity of the face 12*c* opposite the port 28.

The cavity 38 has an external diameter D7, less than D6.

D4 is substantially identical to or slightly greater than the external diameter Dext of the free end 14*b*1 of the external tube 14*b* (FIG. 4).

D6 is substantially identical to or slightly greater than the external diameter D3 of the end 20*b* of the member 20 or of the free end 14*a*1 of the internal tube 14*a*.

The connection of the exchanger 12 to the connector 14 will now be described in reference to FIG. 7 which illustrates the steps of a connection method.

The method comprises a first step a) wherein the free end 14*b*1 of the external tube 14*b* is engaged in the housing 18 of the connector 12. The insertion of the end 14*b*1 in the port 28 is facilitated by the chamfer 42, and continues up to the abutment on the seat 46. The external tube 14*b* forms a male portion engaged in the housing 18 forming a female portion. The opposite, however, can be considered, the free end 14*b*1 then forming a female portion engaged on a male portion of the connector 12. This engagement can be achieved manually by an operator.

The method comprises a following step b) of direct securing of the external tube 14*b* to the connector 12. In the case where these two elements are made of metal alloy, this securing can be achieved by welding, for example, of the TIG type, an annular welding seam 52 then being formed at the level of the port 28 and of the chamfer 42, around the external tube 14*b* (FIG. 4). In the case where the securing would be achieved by brazing, the brazing could be almost invisible to the naked eye and for example, mainly located inside the housing 18.

In the case where the tube 14*b* and the connector 12 would be made of plastic or composite material, their securing could be ensured by gluing, electron beam welding, etc.

Coming from step b), the external tube 14*b* is fixed to the connector 12 and the internal tube 14*a* is not yet present in the device 10. The channel C1 is then in fluidic communication with the port 30 via the cavity 36.

The internal tube 14*a* is mounted in the following step c). The internal tube 14*a* is inserted in the external tube 14*b* until the free end 14*a*1 of the internal tube is engaged in the housing 26 of the connector 12.

The insertion of the end 14*a*1 in the housing 26 is facilitated by the chamfer 44 and continues up to the abutment on the seat 48. The internal tube 14*a* also forms a male portion engaged in the housing 26 forming a female portion. The opposite however can be considered, the free end 14*a*1 thus forming a female portion engaged on a male portion of the connector 12. This engagement can be achieved manually by an operator. It is understood that, insofar as the tubes are relatively rigid, these tubes are preferably straight to facilitate step c).

The mounting of the internal tube 14*a* in the connector 12 is such that it ensures, only to itself, a sealing between the internal tube and the connector. It is therefore not necessary to provide a direct securing between these elements.

This sealing can be ensured by a simple engagement of shapes or a simple bearing of complementary cylindrical surfaces between the internal tube 14*a* and the connector 12.

In the example represented in the drawings, the sealing is ensured by seals 24 of which the number and the material can be adapted, as mentioned above.

The channel C2 is thus in fluidic communication with the port 32 via the cavity 38.

In the case represented and as mentioned above, the method comprises two additional optional steps, between steps b) and c), which consist, on the one hand, of shaping the free end 14*a*1 of the internal tube 14*a*, or a member 20 which is then applied to the end of the tube, then of mounting the seals 24 in the recesses 22 of this free end 14*a*1.

The method finally comprises a step d) wherein the tubes 14*a*, 14*b* are secured together to avoid relative displacements between them.

This securing can be achieved by the shaping of the exchanger 14, and in particular its bending, as mentioned above in relation to FIG. 2. The tubes 14*a*, 14*b* are thus plastically deformed and kept clamped against one another, thus preventing any relative movement between them.

The securing can be achieved by plastic deformation of one of the tubes, and for example, the external tube 14*b* which is crimped on the internal tube 14*a* in a specific place E (see FIG. 8). In the example represented, the crimping is conveyed by dents 54 and plastic deformations located in the external tube 14*b* to bear on the internal tube 14*a*.

This securing can furthermore be achieved by welding together the ends of the tubes 14*a*, 14*b*, opposite the connector 12 and therefore located on the side of the other connector 16.

The present disclosure makes it possible to achieve a sealed fluidic connection between the exchanger 14 and the connector 12, without welding in a blind manner while limiting the bulk of the device 10.

While illustrative embodiments have been illustrated and described, it will be appreciated that various changes can be made therein without departing from the spirit and scope of the disclosed subject matter.

The embodiments of the invention in which an exclusive property or privilege is claimed are defined as follows:

1. A method for providing a sealed connection between a connector and a heat exchanger of the coaxial tubular type, the exchanger comprising two coaxial tubes, respectively internal and external, the external tube defining around the internal tube, a first annular channel configured to circulate a first fluid, and the internal tube defining a second internal channel configured to circulate a second fluid, the tubes being independent from one another and one of the tubes comprising projections in abutment on the other of the tubes to keep the tubes at a distance from one another, the connector comprising two cavities for the passage of the fluids communicating respectively with the first and second channels of the exchanger, the method comprising the successive steps of:

a) mounting a free end of the external tube in or on the connector;

b) directly securing the external tube to the connector;

c) inserting the internal tube in the external tube until a free end of the internal tube is mounted in or on the connector, wherein the mounting is configured to ensure a sealing between the internal tube and the connector; and d) directly securing the internal and external tubes against one another to avoid relative displacements.

2. The method according to claim 1, wherein step d) is carried out by plastic deformation of at least one of the tubes.

3. The method according to claim 1, further comprising between steps b) and c), a step of mounting at least one annular seal around the free end of the internal tube.

4. The method according to claim 1, wherein, during steps a) and c), the tubes are engaged by male-female interlocking, respectively in two housings of the connector.

5. The method according to claim 4, wherein, during steps a) and c), the tubes are guided at the inlet of the housings by engagement of their free ends with chamfers of the connector.

6. The method according to claim 1, wherein, before step c), the free end of the internal tube is plastically deformed or comprises a plastically deformed member, to achieve at least one annular recess at its external periphery, and preferably two annular recesses adjacent to its external periphery.

7. The method according to claim 1, wherein, before step c), the free end of the internal tube is plastically deformed or comprises a plastically deformed member, to modify its external diameter at least one end.

8. The method according to claim 1, wherein the internal and external tubes are made of metallic materials.

9. The method according to claim 1, wherein the internal and external tubes are made of different materials.

10. The method according to claim 9, wherein the internal tube is metallic, and the external tube is made of plastic or composite material.

11. The method according claim 1, wherein the securing of the external tube to the connector is achieved by welding, brazing or gluing.

12. The method according to claim 1, wherein the connector is metallic.

* * * * *